US011208771B2

(12) United States Patent
DeLong et al.

(10) Patent No.: US 11,208,771 B2
(45) **Date of Patent: *Dec. 28, 2021**

(54) SYSTEM AND METHOD FOR CONTROLLING PLUNGE VELOCITY FOR MILLING AND RECLAIMING MACHINES

(71) Applicant: Caterpillar Paving Products Inc., Brooklyn Park, MN (US)

(72) Inventors: James A. DeLong, Brooklyn Park, MN (US); Jacob R. Ellwein, Oak Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/689,886

(22) Filed: Nov. 20, 2019

(65) Prior Publication Data

US 2021/0148066 A1 May 20, 2021

(51) Int. Cl.
*E01C 23/088* (2006.01)
*E01C 23/12* (2006.01)
*E01C 23/06* (2006.01)

(52) U.S. Cl.
CPC ..... *E01C 23/088* (2013.01); *E01C 23/065* (2013.01); *E01C 23/127* (2013.01); *E01C 23/06* (2013.01)

(58) Field of Classification Search
CPC . G05B 2219/2616; E01C 21/00; E01C 23/06; E01C 23/065; E01C 23/088; E01C 23/127
See application file for complete search history.

(56) References Cited

U.S. PATENT DOCUMENTS

| | | | | |
|---|---|---|---|---|
| 5,415,495 | A * | 5/1995 | Johnson | E01C 23/088 404/84.05 |
| 5,607,205 | A * | 3/1997 | Burdick | E01C 19/00 299/1.5 |
| 6,152,648 | A * | 11/2000 | Gfroerer | E01C 23/088 299/1.5 |
| 9,581,691 | B2 | 2/2017 | Simicevic et al. | |
| 9,605,393 | B2 | 3/2017 | Schlenker et al. | |
| 10,145,837 | B2 | 12/2018 | Troxler | |
| 10,287,882 | B2 | 5/2019 | Barimani et al. | |
| 10,344,435 | B2 | 7/2019 | Berning et al. | |
| 10,386,866 | B2 * | 8/2019 | DeLong | G05D 13/62 |
| 2013/0002002 | A1 * | 1/2013 | Menzenbach | E01C 23/088 299/1.5 |
| 2015/0117951 | A1 * | 4/2015 | Schlenker | E01C 23/088 404/84.05 |
| 2016/0348324 | A1 * | 12/2016 | Engelmann | E01C 23/127 |
| 2020/0040534 | A1 * | 2/2020 | Avans | G01L 5/0061 |

FOREIGN PATENT DOCUMENTS

| | | |
|---|---|---|
| CN | 201581420 | 9/2010 |
| CN | 202896595 | 4/2013 |
| CN | 105525925 | 9/2017 |

* cited by examiner

*Primary Examiner* — Janine M Kreck
*Assistant Examiner* — Michael A Goodwin
(74) *Attorney, Agent, or Firm* — Schwegman, Lundberg & Woessner

(57) ABSTRACT

A milling machine can include a frame; a cutting rotor coupled to the frame, the cutting rotor configured to be lowered a selected distance into a surface; and a controller, the controller being configured to control a plunge rate of the cutting rotor into the surface based on a measured density of the surface.

20 Claims, 4 Drawing Sheets

SYSTEM AND METHOD FOR CONTROLLING PLUNGE VELOCITY FOR MILLING AND RECLAIMING MACHINES

TECHNICAL FIELD

The present disclosure generally relates to a milling machine. More particularly, the present disclosure relates to a system and method for controlling the plunge velocity of the milling machine.

BACKGROUND

Milling machines can include machines such as cold planers and reclaimers. For example, cold planers are powered machines used to remove at least part of a surface of a paved area such as a road, bridge, or parking lot. Typically, cold planers include a frame, a power source, a milling assembly positioned below the frame, and a conveyor system. The milling assembly includes a cutting rotor having numerous cutting bits disposed thereon. As power from the power source is transferred to the milling assembly, this power is further transferred to the cutting rotor, thereby rotating the cutting rotor about its axis. As the rotor rotates, its cutting bits engage the hardened asphalt, concrete or other materials of an existing surface of a paved area, thereby removing layers of these existing structures. The spinning action of the cutting bits transfers these removed layers to the conveyor system which transports the removed material to a separate powered machine such as a haul truck for removal from a work site.

When starting to cut with a cold planer or reclaimer machine it can very hard on the machine to plunge into the cut too quickly. This may lead to damage of the machine. How fast the machine should plunge into the cut depends on depth of the cut and material density. The harder the material being mixed or cut, the slower the machine needs to plunge (lower) into the cut.

U.S. Pat. No. 9,605,393 discloses a ground milling machine that includes a ground characteristic sensor and a controller to change the operating parameters of the milling machine depending on the ground characteristics.

SUMMARY

In an example according to this disclosure, a milling machine can include a frame; a cutting rotor coupled to the frame, the cutting rotor configured to be lowered a selected distance into a surface; and a controller, the controller being configured to control a plunge rate of the cutting rotor into the surface based on a measured density of the surface.

In one example, a milling machine can include a frame; a milling assembly including a drum housing and a cutting rotor, the milling assembly being coupled to the frame, the cutting rotor configured to be lowered a selected distance into a surface; a density sensor configured to measure a density of the surface; and a controller, the controller being configured to control a plunge rate of the cutting rotor into the surface based on the measured density of the surface from the density sensor.

In one example, a method for controlling a plunge rate of a cutting rotor for a milling machine can include measuring a density of a surface using a density sensor; and sending the measured density to controller, wherein the controller is configured to control the plunge rate of the cutting rotor into the surface based on the measured density of the surface.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
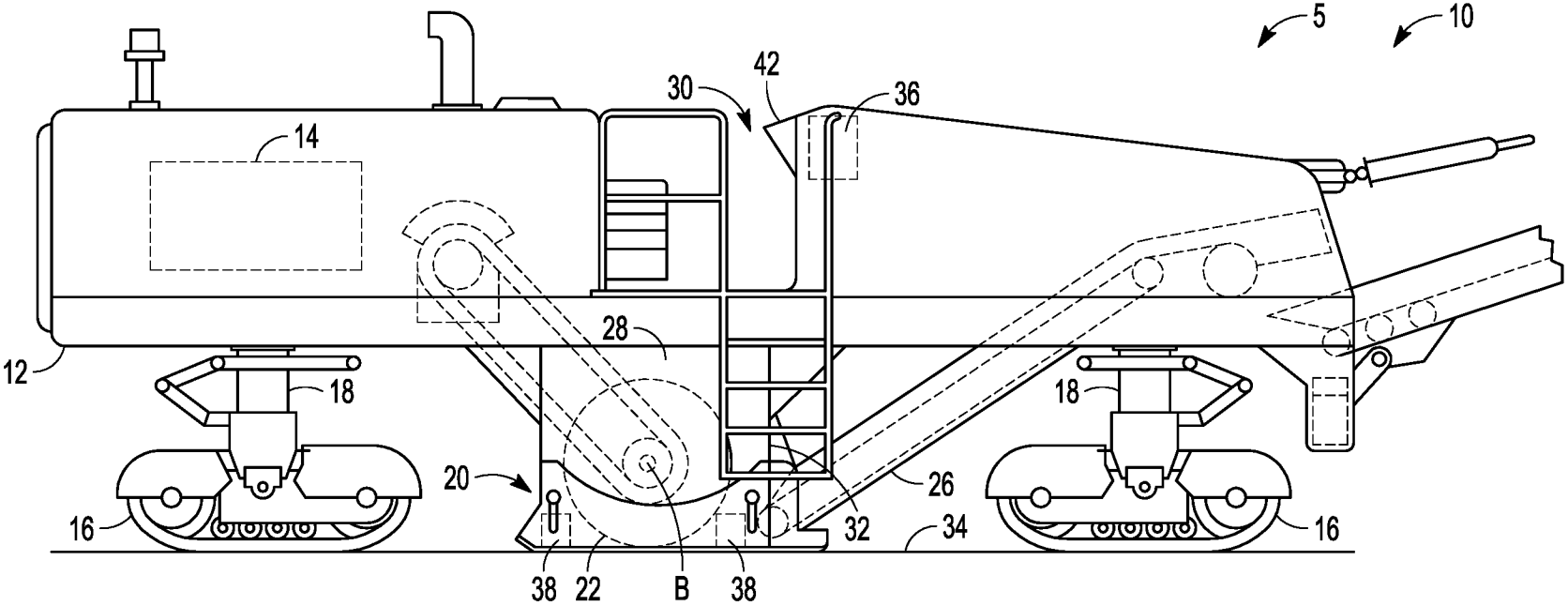
FIG. 1 shows a side view of a milling machine, in accordance with one embodiment.

FIG. 1 shows a side view of a milling machine 5, in accordance with one embodiment. In this example, the milling machine 5 is a cold planer 10. The cold planer 10 includes a frame 12, and a power source 14 connected to the frame 12. The power source 14 may be provided in any number of different forms including, but not limited to, Otto and Diesel cycle internal combustion engines, electric motors, hybrid engines and the like.

The frame 12 is supported by transportation devices 16 via lifting columns 18. The transportation devices 16 may be any kind of ground-engaging device that allows to move the cold planer 10 in a forward direction over a ground surface 34, for example a paved road or a ground already processed by the cold planer 10. For example, in the shown embodiment, the transportation devices 16 are configured as track assemblies. The lifting columns 18 are configured to raise and lower the frame 12 relative to the transportation devices and the ground.

The cold planer 10 further includes a milling assembly 20 connected to the frame 12. The milling assembly 20 includes a drum housing 28 holding a rotatable cutting rotor 22 operatively connected to the power source 14. The cutting rotor 22 can be rotated about a drum axis (B) extending in a direction perpendicular to the frame axis. As the rotatable cutting rotor 22 spins about its drum axis, cutting bits on the cutting rotor 22 can engage hardened materials, such as, for example, asphalt and concrete, of existing roadways, bridges, parking lots and the like. As the cutting bits engage such hardened materials, the cutting bits remove layers of these hardened materials. The spinning action of the rotatable drum 22 and its cutting bits then transfers the hardened materials to a first stage conveyor 26 via a discharge port 32 on the drum housing 28. The first stage conveyor 26 can be coupled to the frame 12 and located at or near the discharge port 32. To lower the cutting rotor 22 into the surface, the lifting columns 18 are adjusted accordingly to allow the for the desired depth of cut.

The drum housing 28 includes front and rear walls, and a top cover positioned above the cutting rotor 22. Furthermore, the drum housing 28 includes lateral covers on the left and right sides of the cutting rotor 22 with respect to a travel direction of the cold planer 10. The drum housing 28 is open toward the ground so that the cutting rotor 22 can engage in the ground from the drum housing 28. The drum housing includes the discharge port 32 in a front wall to discharge material to the first stage conveyor 26, which is located at or near the discharge port 32.

The cold planer 10 further includes an operator station or platform 30 including a control panel 42 for inputting commands to a control system for controlling the cold planer 10, and for outputting information related to an operation of the cold planer 10.

The speed at which the milling machine 5 should plunge into the cut (i.e., lower the cutting rotor 22 to the desired depth of cut in the surface 34) can be difficult to manage and control. For example, when starting to cut with the milling machine 5 it can be very hard on the machine to plunge into the cut too quickly. This can lead to damage of the machine. Flow fast the milling machine 5 should plunge into the cut depends on depth of cut and material density. The harder the material of the surface 34 being mixed or cut, the slower the machine needs to plunge into the cut. Thus, there is need to determine hardness of the material of the surface 34 to determine plunging velocity.

Here, the milling machine 5 includes a controller 36. In this example, the controller 36 can be configured to control a plunge rate or velocity of the cutting rotor 22 into the surface 34 based on a measured density of the surface from a density sensor 38. The plunge rate is the velocity that the cutting rotor 22 is sent downward into the surface 34 to the desired depth of cut.

The present system utilizes the density sensor 38 on the milling machine 5 to pre-determine the relative density of the material of the surface 34 being cut. The density sensor 38 can include a ground penetrating radar (GPR) sensor. Based on this surface density input, and the known depth of cut, the target plunge cut rate or velocity into the surface can be determined. Based on the input of the density sensor 38, the controller 36 controls how fast the milling machine 5 will plunge into the cut. In one example, the density sensor 38 can be located directly on the milling machine 5. For example, the density sensor 38 can be mounted to the drum housing 28. In another example, the density of the surface 34 can be pre-determined and the density of the material of the surface 34 being cut is entered manually into the milling machine 5 by the operator using the control panel 42. The plunge velocity is then controlled using that density value.

In use, if the measured density is relatively high, the controller 36 is configured to use a relatively lower plunge rate. Likewise, if the measured density is relatively low, the controller is configured to use a relatively higher plunge rate.

In this example, the milling machine 5 includes the density sensor 38 coupled to the milling machine 5 proximate the cutting rotor 22 and coupled to the controller 36. The density sensor 38 can be configured to measure the density of the surface 34 and send the density of the surface 34 to the controller 36.

In one example, a plurality of density sensors 38 can be associated with the milling machine 5. For example, there can be four density sensors 38 located around the periphery of the drum housing 28 proximate the cutting rotor 22. Each of the density measurements from the plurality of density sensors 38 can be sent to the controller 36 and the controller 36 can average out the plurality of different density measurements.

Figure 2:
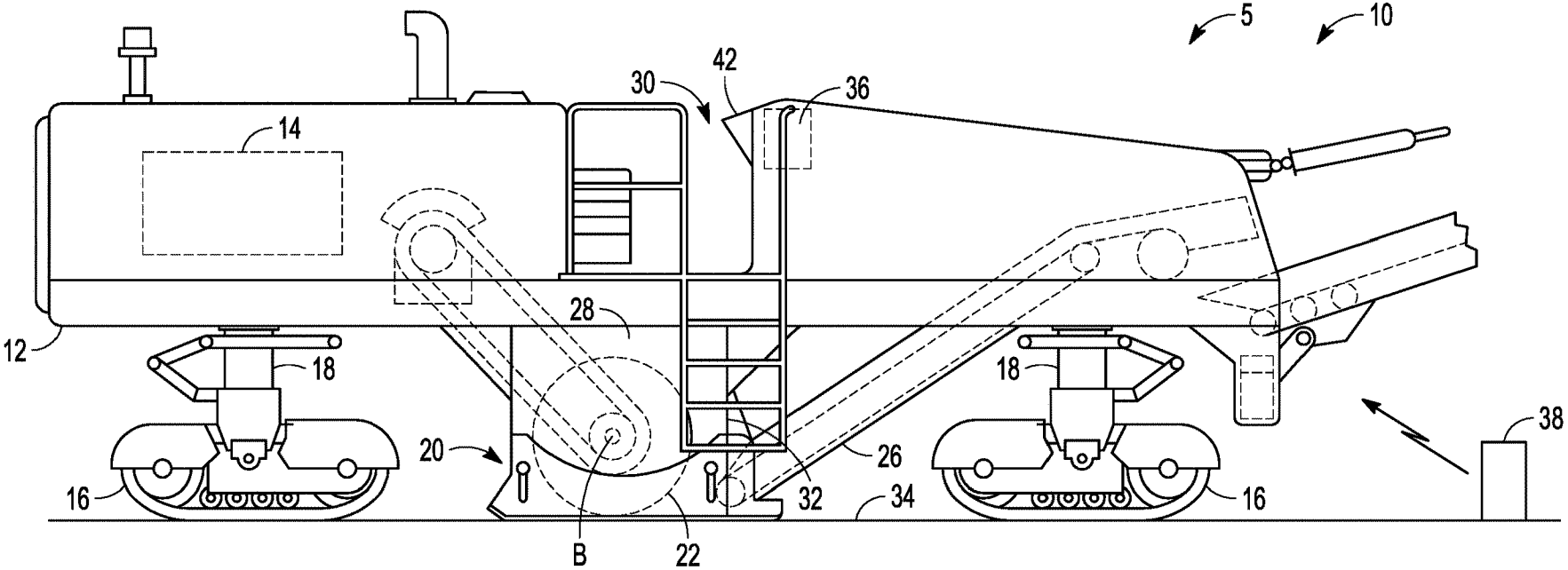
FIG. 2 shows another side view of the milling machine of FIG. 1, in accordance with one embodiment.

In one example, the measured density of the surface 34 can be input to the controller 36 by a machine operator at a control panel 42. For example, FIG. 2 shows a density sensor 38 that is separate from the milling machine 5. For example, the density sensor 38 can be a mobile GPR unit. In this example, the density of the surface 34 can then be sent to the controller 36 by the density sensor 38 or the density sensor reading can be given to the operator who can enter the density measurement of the surface 34 into the controller 36 via the control panel 42.

Figure 3:
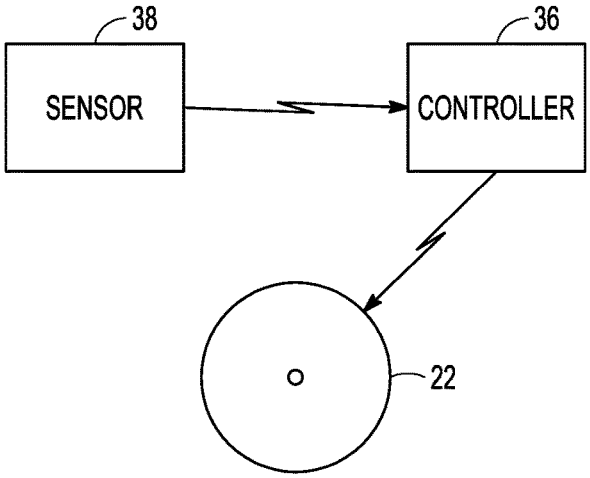
FIG. 3 shows a schematic view of a control system, in accordance with one embodiment.

FIG. 3 shows a schematic representation of the present system. Here, the system includes the density sensor 38 which can be configured to communicate the density of a surface to a controller 36. The controller then controls the plunge rate of the cutting rotor 22 into the surface.

Figure 4:
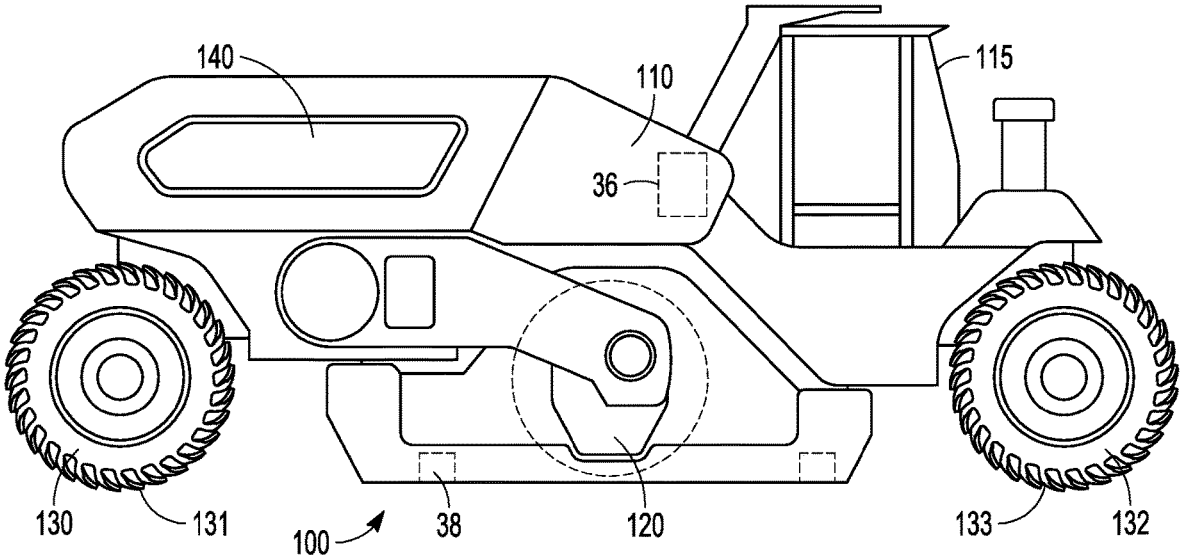
FIG. 4 shows a side view of a reclaimer, in accordance with one embodiment.

FIG. 4 shows a side view of a reclaimer 100, in accordance with one embodiment. The reclaimer 100 can also be known as a rotary mixer or a soil stabilizer. The reclaimer 100 generally includes a frame 110, a rotor 120 attached to the frame 110 and contained within drum housing 122, and four wheels 130, 131, 132, 133 attached to the frame 110 for moving the rotary mixer 100. The rotary mixer 100 can also include a power source 140 such as a diesel engine, which drives the various components, and an operator station 150 which can include various controls to control the operations of the rotary mixer 100.

The rotor 120 is rotated at a predetermined depth to dig up a soil surface or asphalt surface and then to lay the soil or pulverized asphalt back down to prepare a roadbed or other ground preparation. In some examples, further stabilizing material can be added to the soil or pulverized asphalt to be mixed into the roadbed.

In one example, the reclaimer 100 can include a density sensor 38 configured to measure a density of the surface 34. In one embodiment, the density sensor 38 can be coupled to the reclaimer 100 and coupled to the controller 36. The density sensor 38 can be configured to measure the density of the surface 34 and send the density of the surfaces 34 to the controller 36. In a similar manner as discussed above for the cold planer, if the measured density is relatively high, the controller 36 is configured to use a relatively lower plunge rate. Likewise, if the measured density is relatively low, the controller is configured to use a relatively higher plunge rate.

INDUSTRIAL APPLICABILITY

The present system is applicable to a milling machine such as a cold planer or a reclaimer.

As noted, the speed at which the milling machine 5 should plunge into the cut can be difficult to manage and control. For example, when starting to cut with the milling machine 5 it can be very hard on the machine to plunge into the cut too quickly. This can lead to damage of the machine. How fast the milling machine 5 should plunge into the cut depends on depth of cut and material density. The harder the material of the surface 34 being mixed or cut, the slower the machine needs to plunge into the cut. Thus, there is need to determine hardness of the material of the surface 34 to determine plunging velocity.

Figure 5:
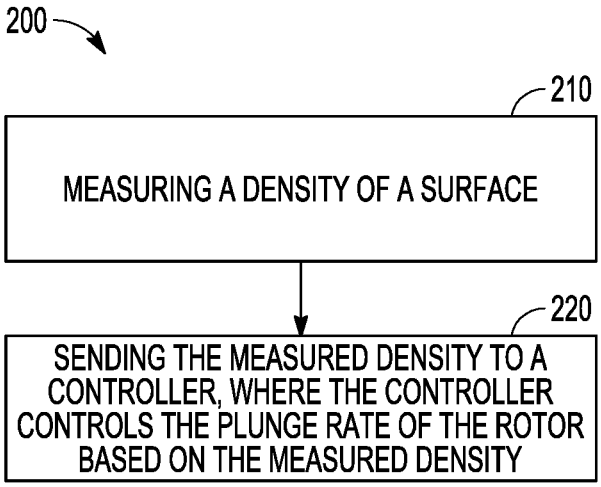
FIG. 5 shows a flowchart of a method, in accordance with one embodiment.

FIG. 5 shows a method of use of the present system. Here, a method 200 for controlling a plunge rate of a cutting rotor 22 for a milling machine 5 can include measuring (210) a density of a surface 34 using a density sensor 38; and sending the measured density (220) to controller 36, wherein the controller 36 is configured to control the plunge rate of the cutting rotor 22 into the surface 34 based on the measured density of the surface.

Here, if the measured density is relatively high, the controller 36 is configured to use a relatively lower plunge rate, and if the measured density is relatively low, the controller 36 is configured to use a relatively higher plunge rate.

For example, the density sensor 38 can include a ground penetrating radar (GPR) sensor and the density sensor 38 is located proximate the cutting rotor 22. In one example, the density sensor can be remote from the milling machine 5.

The above detailed description is intended to be illustrative, and not restrictive. The scope of the disclosure should, therefore, be determined with references to the appended claims, along with the fill scope of equivalents to which such claims are entitled.

What is claimed is:

1. A milling machine comprising:

a frame;

a cutting rotor coupled to the frame, the cutting rotor configured to be lowered a selected distance into a surface; and a controller, the controller being configured to set a plunge rate of the cutting rotor into the surface, before the cutting rotor begins to plunge, based on a depth of cut and a measured density of the surface which is measured before the cutting rotor begins to plunge such that the plunge rate of the cutting rotor is set before the cutting rotor contacts the surface.

2. The milling machine of claim 1, further including a density sensor associated with the milling machine and coupled to the controller, the sensor configured to measure the density of the surface and send the density of the surface to the controller.

3. The milling machine of claim 2, wherein there are a plurality of density sensors associated with the milling machine, and the controller averages out a plurality of different density measurements from the plurality of density sensors.

4. The milling machine of claim 2, wherein the density sensor includes a ground penetrating radar (GPR) sensor.

5. The milling machine of claim 2, wherein the density sensor is located proximate the cutting rotor.

6. The milling machine of claim 1, wherein the measured density of the surface is input to the controller by a machine operator.

7. The milling machine of claim 1, wherein the milling machine comprises a cold planer.

8. The milling machine of claim 1, wherein the milling machine comprises a reclaimer.

9. The milling machine of claim 1, wherein if the measured density is relatively high, the controller is configured to use a relatively lower plunge rate.

10. The milling machine of claim 9, wherein if the measured density is relatively low, the controller is configured to use a relatively higher plunge rate.

11. The milling machine of claim 1, wherein the cutting rotor is part of a milling assembly including a drum housing with the cutting rotor located within the drum housing and wherein the cutting rotor includes a plurality of cutting tools disposed thereon.

12. A milling machine comprising:

a frame;

a milling assembly including a drum housing and a cutting rotor, the milling assembly being coupled to the frame, the cutting rotor configured to be lowered a selected distance into a surface;

a density sensor configured to measure a density of the surface; and a controller, the controller being configured to set a plunge rate of the cutting rotor into the surface, before the cutting rotor begins to plunge, based on a depth of cut and the measured density of the surface from the density sensor which is measured before the cutting rotor begins to plunge such that the plunge rate of the cutting rotor is set before the cutting rotor contacts the surface.

13. The milling machine of claim 12, wherein there are a plurality of density sensors associated with the milling machine, and the controller averages out a plurality of different density measurements from the plurality of density sensors.

14. The milling machine of claim 12, wherein the density sensor includes a ground penetrating radar (GPR) sensor.

15. The milling machine of claim 12, wherein the density sensor is located proximate the cutting rotor.

16. The milling machine of claim 12, wherein the measured density of the surface is input to the controller by a machine operator.

17. The milling machine of claim 12, wherein if the measured density is relatively high, the controller is configured to use a relatively lower plunge rate, and if the measured density is relatively low, the controller is configured to use a relatively higher plunge rate.

18. A method for controlling a plunge rate of a cutting rotor for a milling machine, the method comprising:

measuring a density of a surface using a density sensor before the cutting rotor begins to plunge; and sending the measured density to controller, wherein the controller is configured to set the plunge rate of the cutting rotor into the surface based on the measured density of the surface and a depth of cut.

19. The method of claim 18, wherein the density sensor includes a ground penetrating radar (GPR) sensor and the density sensor is located proximate the cutting rotor.

20. The method of claim 19, wherein if the measured density is relatively high, the controller is configured to use a relatively lower plunge rate, and if the measured density is relatively low, the controller is configured to use a relatively higher plunge rate.

* * * * *